US011465713B2

(12) United States Patent
Suzuki et al.

(10) Patent No.: US 11,465,713 B2
(45) Date of Patent: Oct. 11, 2022

(54) BOAT

(71) Applicant: YAMAHA HATSUDOKI KABUSHIKI KAISHA, Iwata (JP)

(72) Inventors: Masaru Suzuki, Shizuoka (JP); Tomohiro Suzuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 51 days.

(21) Appl. No.: 17/155,203

(22) Filed: Jan. 22, 2021

(65) Prior Publication Data

US 2021/0229778 A1 Jul. 29, 2021

(30) Foreign Application Priority Data

Jan. 23, 2020 (JP) ..... JP2020-009437

(51) Int. Cl.

| | |
|---|---|
| ***B63B 3/48*** | (2006.01) |
| ***B63H 25/02*** | (2006.01) |
| ***B63B 11/00*** | (2006.01) |
| ***B63B 13/00*** | (2006.01) |

(52) U.S. Cl.

CPC ..... *B63B 3/48* (2013.01); *B63B 11/00* (2013.01); *B63B 13/00* (2013.01); *B63H 25/02* (2013.01)

(58) Field of Classification Search

CPC .. B63B 3/00; B63B 3/48; B63B 11/00; B63B 13/00; B63H 25/00; B63H 25/02

USPC ..... 114/55.51, 55.57

See application file for complete search history.

(56) References Cited

U.S. PATENT DOCUMENTS 5,390,621 A * 2/1995 Hattori ..... B63B 34/10 114/55.51
6,276,290 B1 * 8/2001 Yamada ..... B63B 34/10 114/55.51

FOREIGN PATENT DOCUMENTS

JP 2005-119513 A 5/2005

* cited by examiner

*Primary Examiner* — Lars A Olson

(74) *Attorney, Agent, or Firm* — Keating and Bennett, LLP

(57) ABSTRACT

A boat includes a hull, a deck, and a bow hatch. An engine compartment is provided in the hull. The deck is mounted on an upper portion of the hull. The deck includes an air inlet port that opens rearward to supply air to the engine compartment. The bow hatch is attached to the deck. The bow hatch includes a wall that faces the air inlet port.

11 Claims, 7 Drawing Sheets

BOAT

CROSS REFERENCE TO RELATED APPLICATIONS

This application claims the benefit of priority to Japanese Patent Application No. 2020-009437 filed on Jan. 23, 2020. The entire contents of this application are hereby incorporated herein by reference.

BACKGROUND OF THE INVENTION

1. Field of the Invention

The present invention relates to boats.

2. Description of the Related Art

A conventional boat includes a hull in which an engine is disposed, a deck mounted to an upper portion of the hull, and a bow hatch connected to the deck (see Japanese Patent Publication No. 2005-119513). In a conventional boat, the deck includes an air inlet port for supplying air to the engine which is disposed in an engine compartment. The air inlet port opens upward.

In a conventional boat, water may easily enter the air inlet port because the air inlet port opens upward. In other words, in a conventional boat, water may easily enter the engine compartment from the air inlet port.

SUMMARY OF THE INVENTION

Preferred embodiments of the present invention provide boats each of which significantly reduces or prevents intrusion of water from an air inlet port into an engine compartment.

A boat according to a preferred embodiment of the present invention includes a hull, a deck, and a bow hatch. An engine compartment is provided in the hull. The deck is mounted on an upper portion of the hull. The deck includes an air inlet port. The air inlet port opens rearward to supply air to the engine compartment. The bow hatch is attached to the deck. The bow hatch includes a wall that faces the air inlet port.

According to preferred embodiments of the present invention, it is possible to significantly reduce or prevent the intrusion of water from the air inlet port into the engine compartment in the boats.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
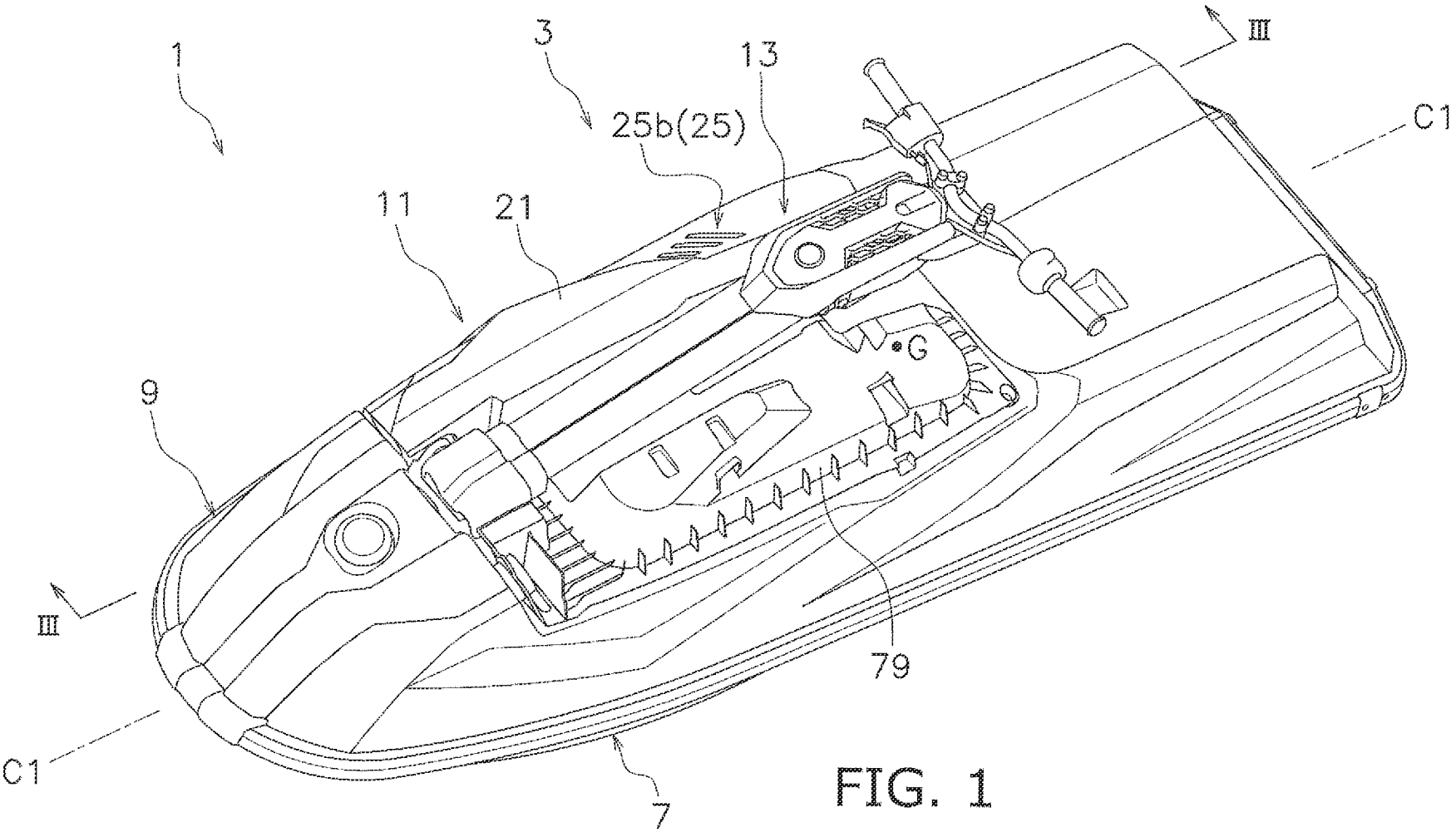
FIG. 1 is a perspective view of a boat according to a preferred embodiment of the present invention.

Hereinafter, preferred embodiments of the present invention will be described with reference to the drawings. In the following description, the front, rear, left, right, up, and down directions refer to the front, rear, left, right, up, and down directions of the boat 1, respectively. For example, a boat center line C1 extending in the front-rear direction of the boat 1 passes through the center G of gravity of a boat body 3. FIG. 1 shows a state in which a left cover 21 is removed.

The front-rear direction is a direction along the boat center line C1. The front direction is a direction toward a left side along the boat center line C1 of FIG. 1. For example, the front direction is a direction in which the boat 1 moves forward. The rear direction is a direction toward a right side along the boat center line C1 in FIG. 1. For example, the rear direction is a direction opposite to a direction in which the boat 1 moves forward.

The left-right direction (a width direction) is a direction perpendicular to the boat center line C1. The left direction is a direction toward a lower side perpendicular to the boat center line C1 in FIG. 1. The right direction is a direction toward an upper side perpendicular to the boat center line C1 in FIG. 1. The vertical direction is a direction perpendicular to the front-rear direction and the left-right direction.

"In a top view of boat body 3" means "when the boat body 3 is viewed from an upper side". "In a side view of boat body 3" means "when the boat body 3 is viewed from a side". "In a front view of boat body 3" means "when the boat body 3 is viewed from a front side". "In a rear view of boat body 3" means "when the boat body 3 is viewed from a rear side".

Figure 2:
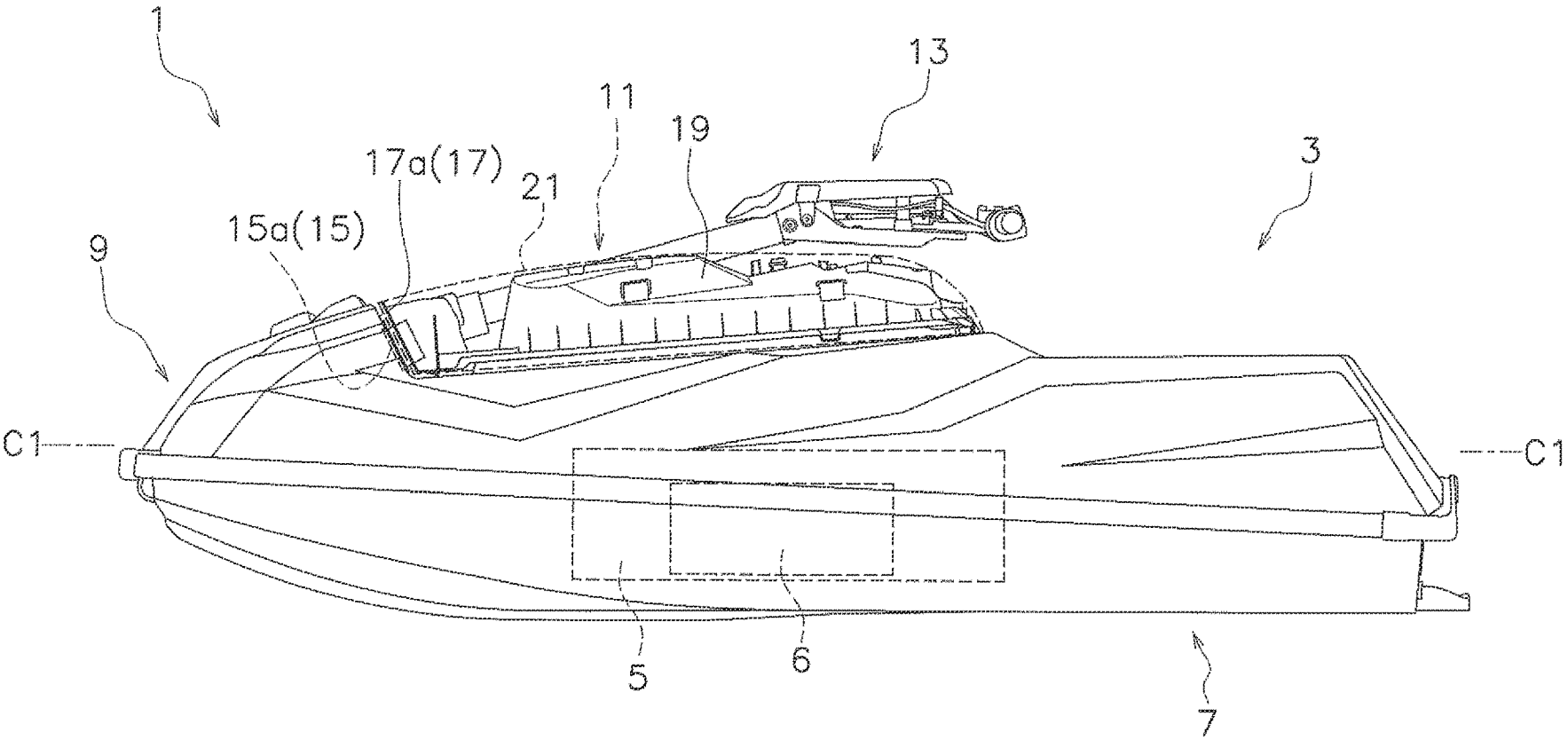
FIG. 2 is a side view of the boat.
Figure 7:
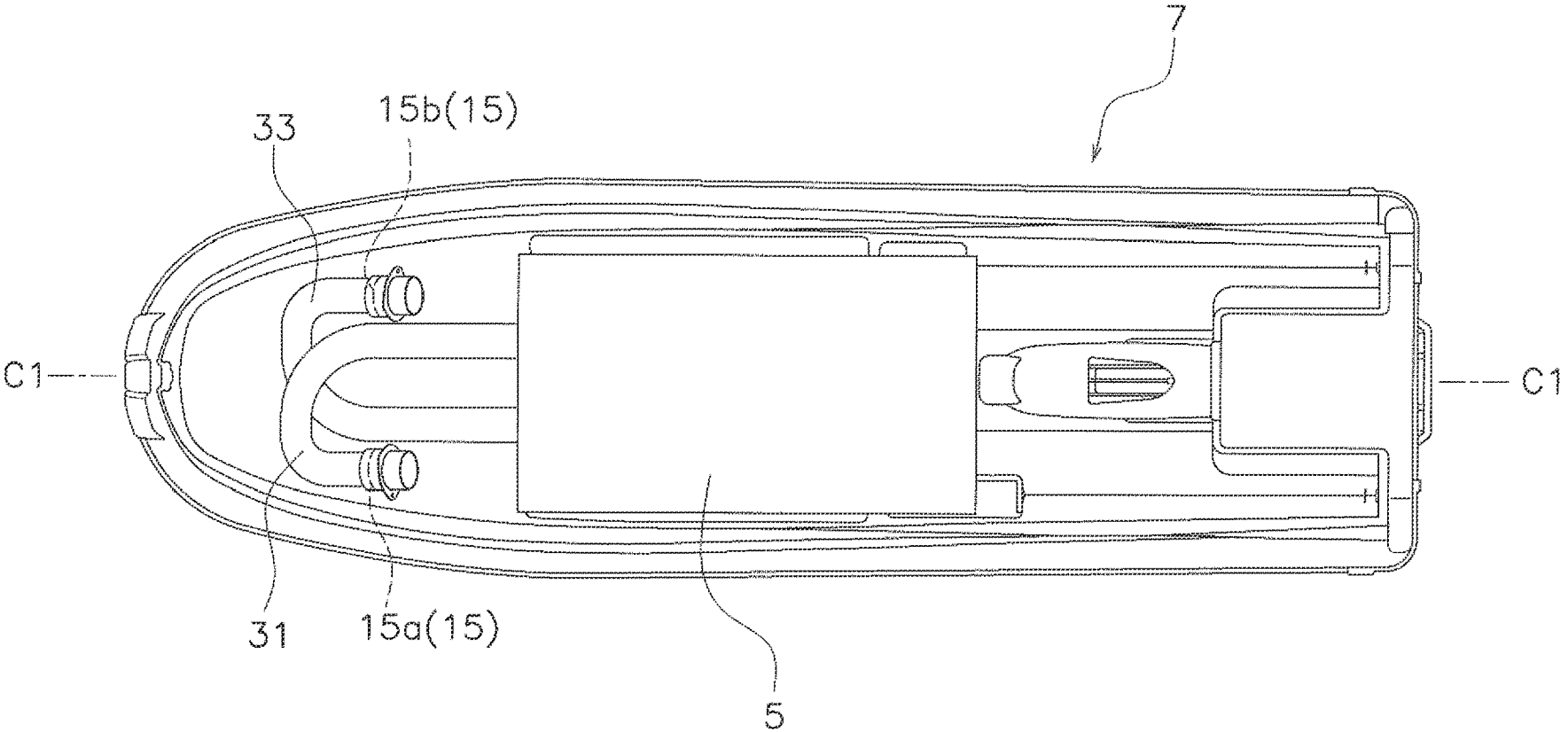
FIG. 7 explains the layout of a first duct and a second duct.

As shown in FIGS. 1 and 2, the boat 1 is a stand-ride type small jet propulsion boat. The boat 1 includes the boat body 3. As shown in FIG. 2, an engine compartment 5 is provided in the boat body 3. The engine 6 is located in the engine compartment 5. The engine 6 is a power source to propel the boat body 3. As shown in FIGS. 1 and 2, the boat body 3 includes a hull 7, a deck 9, and a bow hatch 11. The boat body 3 further includes a steering pole 13 (an example of a tiltable operator). As shown in FIG. 7, the boat body 3 further includes a first duct 31 and a second duct 33.

As shown in FIG. 1, the hull 7 defines the bottom of the boat body 3. The hull 7 has a concave shape. As shown in FIG. 2, the engine compartment 5 is provided on the hull 7.

As shown in FIGS. 1 and 2, the deck 9 is mounted on an upper portion of the hull 7.

Figure 3:
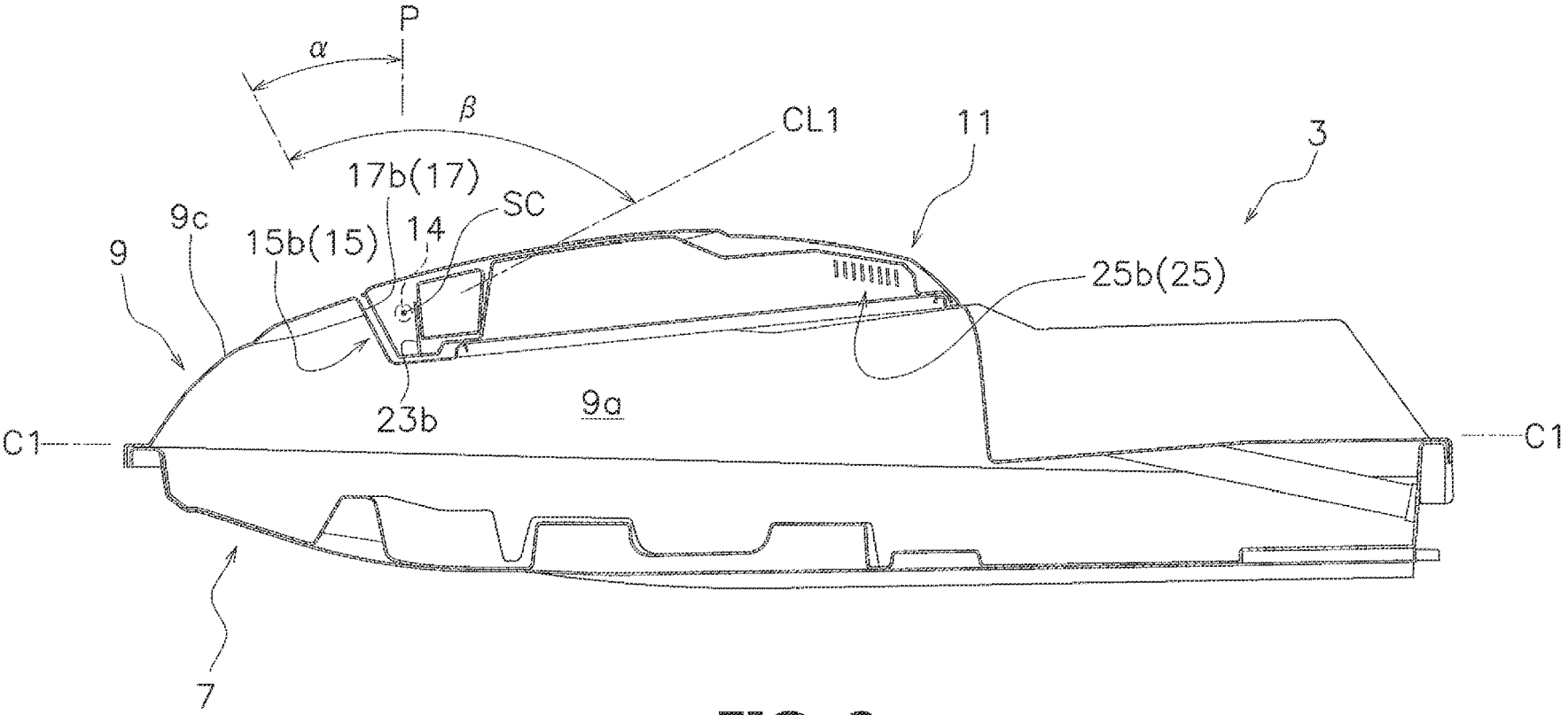
FIG. 3 is a sectional view in which the boat is cut by a cutting line (III-III) of FIG. 1.
Figure 4:
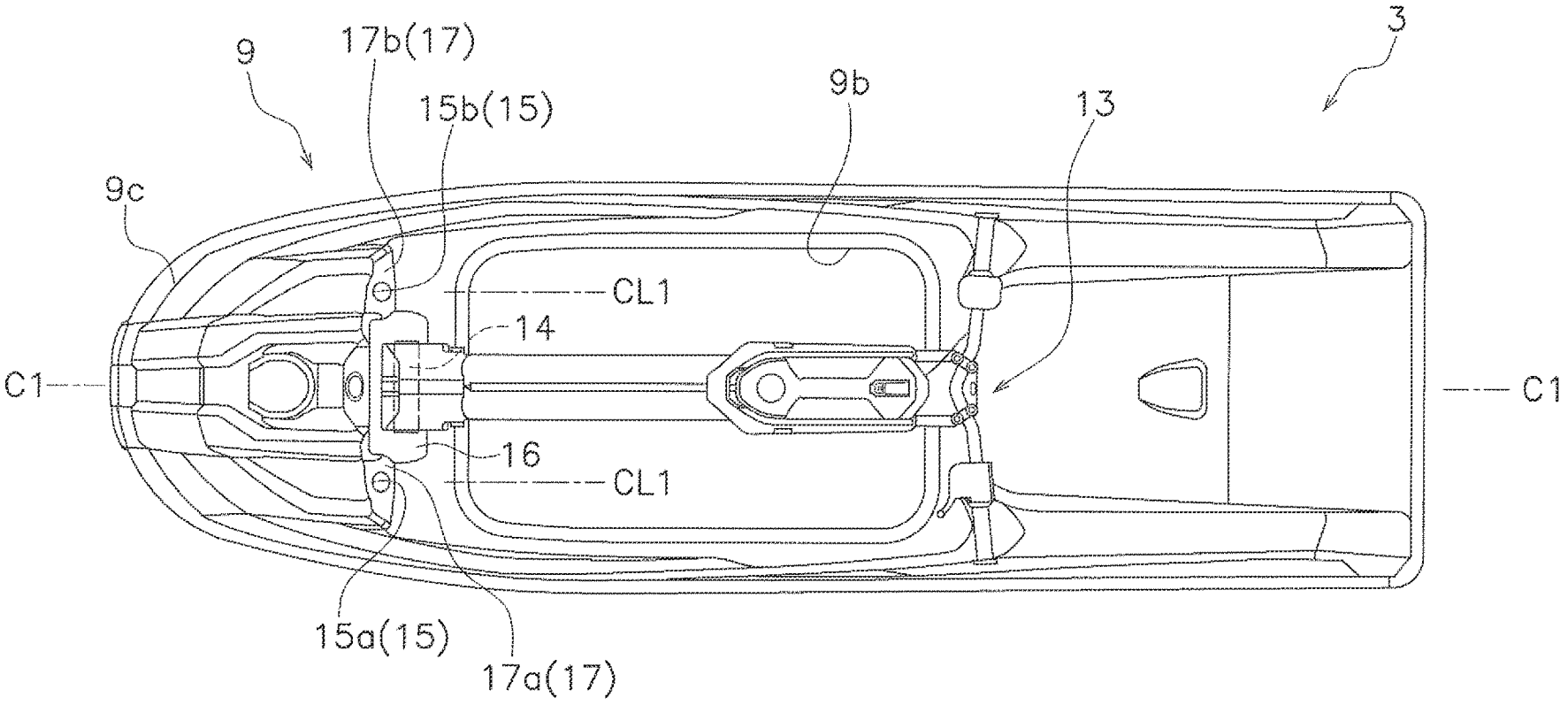
FIG. 4 is a top view of the boat in a state in which the bow hatch is removed.

As shown in FIGS. 2 and 3, the deck 9 includes an air inlet port 15 and an inclined surface 17. Specifically, as shown in FIG. 4, the deck 9 includes a pair of air inlet ports 15*a*, 15*b* and a pair of inclined surfaces 17*a*, 17*b*. FIG. 4 is a top view in a state in which the bow hatch 11 is removed.

Specifically, as shown in FIGS. 3 and 4, the deck 9 includes a deck body 9*a*, an opening 9*b* (see FIG. 4), and a bulging portion 9*c*. The opening 9*b* is provided on the deck body 9*a*. A bow hatch 11 is located over the opening 9*b*.

As shown in FIG. 3, the bulging portion 9*c* bulges from the deck body 9*a*. For example, as shown in FIG. 4, the bulging portion 9*c* is adjacent to the opening 9*b*. Specifically, the bulging portion 9*c* is located on the deck body 9*a* in front of the opening 9*b*. The pair of inclined surfaces 17*a*, 17*b* are located on the bulging portion 9*c*.

The pair of air inlet ports 15*a* and 15*b* supply air to the engine 6. Specifically, the pair of air inlet ports 15*a* and 15*b* supply outside air taken into an internal space of the bow hatch 11 to the engine compartment 5.

As shown in FIGS. 3 and 4, the pair of air inlet ports 15*a*, 15*b* are located in the bulging portion 9*c*. For example, The pair of air inlet ports 15*a*, 15*b* are located on the pair of inclined surfaces 17*a*, 17*b* of the bulging portion 9*c* respectively.

Each of the pair of air inlet ports 15*a*, 15*b* opens rearward. For example, each of the pair of air inlet ports 15*a*, 15*b* opens obliquely upward and rearward. Specifically, each of the pair of air inlet ports 15*a*, 15*b* opens in the direction in which the opening center line CL1 extends.

The opening center line CL1 passes through a geometric center of a figure defined by inner surfaces of the air inlet ports 15*a*, 15*b*. The opening center line CL1 extends in a direction perpendicular or substantially perpendicular to the inclined surfaces 17*a*, 17*b* in the side view of the boat body 3.

The pair of inclined surfaces 17*a*, 17*b* are located on the bulging portion 9*c*. For example, the pair of inclined surfaces 17*a*, 17*b* define a rear surface of the bulging portion 9*c*. It is preferable that an inclination angle α of each of the pair of inclined surfaces 17*a*, 17*b* are defined as follows in a state in which the boat body 3 is stationary on a water surface.

Preferably, the inclined surfaces 17*a*, 17*b* have an inclination angle α, defined by the inclined surfaces 17*a*, 17*b* and a plane P including a center axis SC of a pivot shaft 14 (described below) and that extends in a direction in which gravity acts, that is equal to or larger than about 20 degrees and equal to or less than about 80 degrees, for example. Preferably, the air inlet ports 15*a*, 15*b* are provided on the inclined surfaces 17*a*, 17*b* so that an angle β, defined by the opening center line CL1 and the inclined surfaces 17*a*, 17*b*, is equal to or larger than about 10 degrees and equal to or less than about 70 degrees, for example, in the side view of the boat body 3.

In the present preferred embodiment, the inclined surfaces 17*a*, 17*b* have an inclination angle α, defined by the plane P and the inclined surfaces 17*a*, 17*b*, that is equal to or larger than about 25 degrees and equal to or less than about 70 degrees. The air inlet ports 15*a*, 15*b* are provided on the inclined surfaces 17*a*, 17*b* so that the angle β, defined by the opening center line CL1 and the inclined surfaces 17*a*, 17*b*, is equal to or larger than about 20 degrees and equal to or less than about 65 degrees, for example, in the side view of the boat body 3.

As shown in FIGS. 1 to 3, the bow hatch 11 is attached to the deck 9. The bow hatch 11 is detachably mounted to the deck 9. The bow hatch 11 is located on the deck body 9*a* so as to cover the opening 9*b* (see FIG. 4) of the deck 9. The bow hatch 11 faces the bulging portion 9*c* of the deck 9. Specifically, the bow hatch 11 faces the pair of inclined surfaces 17*a*, 17*b* of the bulging portion 9*c*.

As shown in FIGS. 1 and 2, the bow hatch 11 includes a hatch body 19 (an example of a main body) and a cover 21. The hatch body 19 is mounted to the cover 21. In this state, the hatch body 19 is detachably mounted to the deck body 9*a*.

Figure 5:
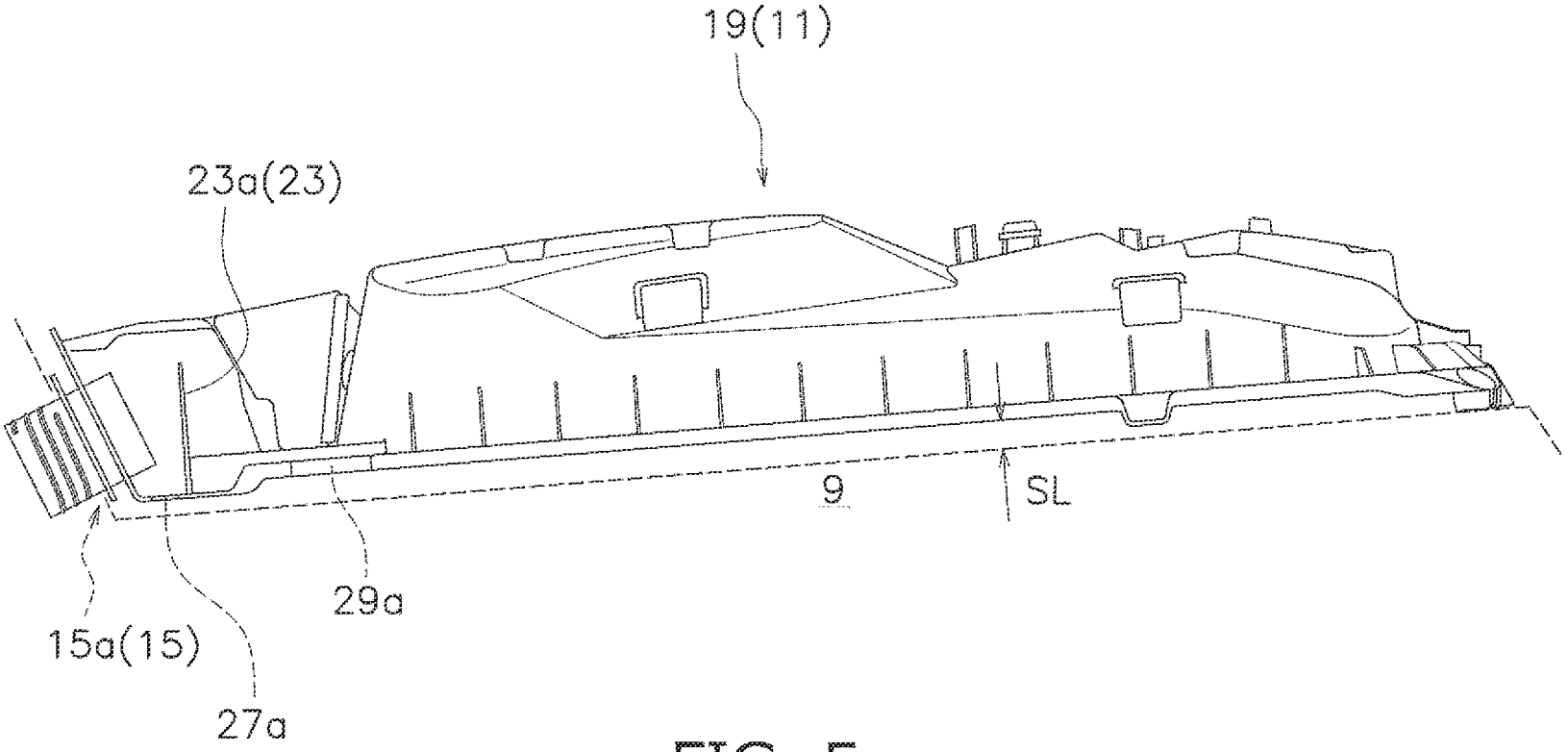
FIG. 5 is a side view of a hatch body of the bow hatch.

As shown in FIG. 5, the hatch body 19 is located between the cover 21 and the deck 9 in a state in which the bow hatch 11 is mounted to the deck 9. In a state in which the bow hatch 11 is mounted to the deck 9, a drain gap SL is provided between the hatch body 19 and the deck 9.

As shown in FIG. 2, the cover 21 covers the hatch body 19. An internal space of the bow hatch 11 is provided between the cover 21 and the hatch body 19. The internal space of the bow hatch 11 guides the outside air from a pair of outside-air inlet ports 25*b* (see FIGS. 1 and 3) to the pair of air inlet ports 15*a*, 15*b*. In this preferred embodiment, only the outside-air inlet port 25*b* on the right side is illustrated, and the outside-air inlet port on the left side is omitted. The upper surface of the cover has a concave shape to accommodate the steering pole 13.

The bow hatch 11 further includes a wall 23, an outside-air inlet port 25 (an example of an opening), a first drain port 27, and a second drain port 29. Specifically, the bow hatch 11 includes a pair of walls 23*a*, 23*b*, a pair of outside-air inlet ports 25*b*, a pair of first drain ports 27*a*, 27*b*, and a pair of second drain ports 29*a*, 29*b*.

Figure 6:
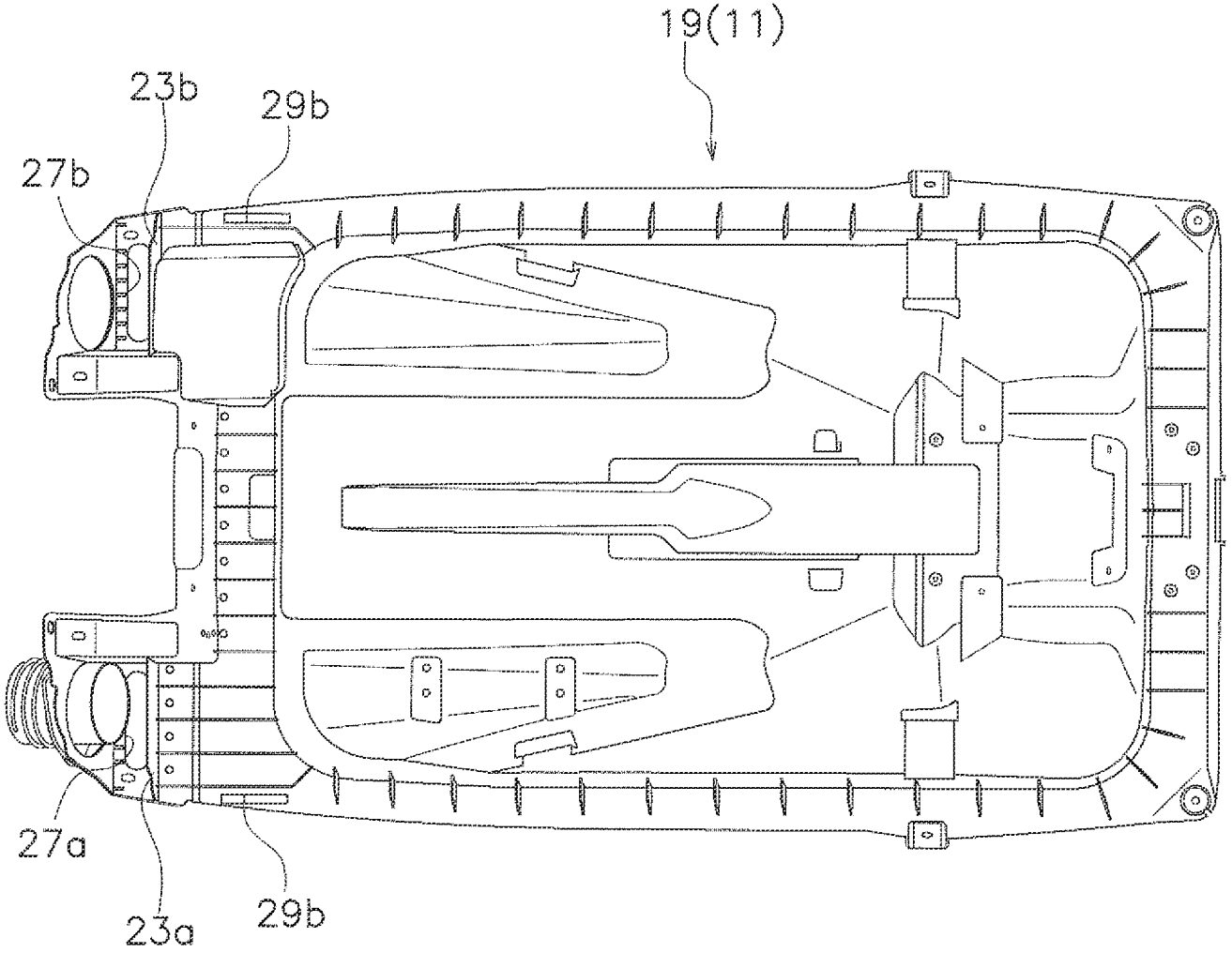
FIG. 6 is a top view of the hatch body of the bow hatch.

The pair of walls 23*a*, 23*b* prevent the intrusion of water into the pair of air inlet ports 15*a*, 15*b*. As shown in FIGS. 5 and 6, the pair of walls 23*a*, 23*b* are provided on the hatch body 19. For example, the pair of walls 23*a*, 23*b* are integral with the hatch body 19 so as to protrude from the hatch body 19.

As shown in FIG. 3, each of the pair of walls 23*a*, 23*b* protrudes from the hatch body 19 toward the cover 21 in a state in which the cover 21 is mounted to the hatch body 19.

The pair of walls 23*a*, 23*b* are located in the internal space of the bow hatch 11. The tip of each of the pair of walls 23*a*, 23*b* is spaced apart from an inner surface of the cover 21. With this configuration, the outside air taken into the internal space of the bow hatch 11 is able to pass between the tip of each of the pair of walls 23*a*, 23*b* and the inner surface of the cover 21.

The pair of walls 23*a*, 23*b* face the pair of air inlet ports 15*a*, 15*b* respectively in a state in which the bow hatch 11 is mounted to the deck 9. Each of the pair of walls 23*a*, 23*b* is located respectively between each of the pair of air inlet ports 15*a*, 15*b* and each of the pair of outside-air inlet ports 25*b* in the state in which the bow hatch 11 is mounted to the deck 9.

As shown in FIGS. 1 and 3, the pair of outside-air inlet ports 25*b* take in outside air. A pair of outside-air inlet ports 25*b* are provided in the cover 21. For example, a pair of outside-air inlet ports 25*b* are located at the rear portion of the cover 21. Specifically, the pair of outside-air inlet ports 25*b* penetrate the cover 21 behind the pair of walls 23*a*, 23*b*.

As shown in FIGS. 5 and 6, the pair of first drain ports 27*a*, 27*b* discharge water that intrudes between the air inlet ports 15*a*, 15*b* and the walls 23*a*, 23*b*. The pair of first drain ports 27*a*, 27*b* are provided between the pair of air inlet ports 15*a*, 15*b* and the pair of walls 23*a*, 23*b*, respectively.

The pair of second drain ports 29*a*, 29*b* discharge water that intrudes behind the walls 23*a*, 23*b*. The pair of second drain ports 29*a*, 29*b* are provided behind the pair of walls 23*a*, 23*b*, respectively.

The water, which is discharged from the pair of first drain ports 27*a*, 27*b* and the pair of second drain ports 29*a*, 29*b*, is discharged from the drain gap SL (see FIG. 5) provided between the bow hatch 11 (hatch body 19) and the deck 9.

As shown in FIGS. 1 and 4, the steering pole 13 is supported by the pivot shaft 14 so as to be swingable with respect to the pivot shaft 14. The steering pole 13 is swingably mounted to the deck 9 via the pivot shaft 14.

As shown in FIG. 4, the pivot shaft 14 is mounted to the deck 9. For example, the pivot shaft 14 is mounted to the deck 9 via an attachment member 16. Specifically, the pivot shaft 14 is supported by the attaching member 16. The attaching member 16 is fixed to the deck body 9*a* and the bulging portion 9*c*. The pivot shaft 14 extends in a direction perpendicular or substantially perpendicular to the boat center line C1 in the top view of the boat body 3. For example, the pivot shaft 14 extends in the left-right direction.

As shown in FIG. 7, the first duct 31 extends from the air inlet port 15*a* toward the engine compartment 5. In the following, the air inlet port 15*a* is described as a first air inlet port. The first air inlet port 15*a* is located on a first side spaced apart from a major axis (long axis) of the hull 7 in the top view.

The second duct 33 extends from the air inlet port 15*b* toward the engine compartment 5. In the following, the air inlet port 15*b* is described as a second air inlet port. The second air inlet port 15*b* is located on a second side opposite to the first side in the top view.

As shown in FIG. 7, a first end of the first duct 31 is located at the first air inlet port 15*a* (see FIG. 4). For example, the first end of the first duct 31 is mounted to the first air inlet port 15*a*. A second end of the first duct 31 is connected to the engine compartment 5 on the second side.

As shown in FIG. 7, a first end of the second duct 33 is located at the second air inlet port 15*b* (see FIG. 4). For example, the first end of the second duct 33 is mounted to the second air inlet port 15*b*. A second end of the second duct 33 is connected to the engine compartment 5 on the first side.

In this configuration, even if the boat body 3 swings around a roll axis and the first air inlet port 15*a* or the second air inlet port 15*b* is located below the water surface, it is possible to significantly reduce or prevent the intrusion of water into the engine compartment 5 because the first duct 31 and the second duct 33 intersect.

In the boat 1 including the above configuration, it is possible to significantly reduce or prevent the intrusion of water into the pair of air inlet ports 15*a*, 15*b* because the pair of air inlet ports 15*a*, 15*b* open rearward. Also, it is possible to significantly reduce or prevent the intrusion of water into the pair of air inlet ports 15*a*, 15*b* because the pair of walls 23*a*, 23*b* face the pair of air inlet ports 15*a*, 15*b*, According to preferred embodiments of the present invention, it is possible to significantly reduce or prevent the intrusion of water from the air inlet port into the engine compartment in a boat.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat comprising:

a hull including an engine compartment;

a deck mounted on an upper portion of the hull and including an air inlet port that opens rearward to supply air to the engine compartment; and a bow hatch attached to the deck and including a main body, a cover to cover the main body, and a wall that protrudes from the main body towards the cover and faces the air inlet port.

2. The boat according to claim 1, wherein the bow hatch includes an opening to take in outside air; and the wall is located between the air inlet port and the opening.

3. A boat comprising:

a hull including an engine compartment;

a deck mounted on an upper portion of the hull and including an air inlet port that opens rearward to supply air to the engine compartment; and a bow hatch attached to the deck and including a wall that faces the air inlet port; wherein the bow hatch includes a first drain port located between the air inlet port and the wall.

4. A boat comprising:

a hull including an engine compartment;

a deck mounted on an upper portion of the hull and including an air inlet port that opens rearward to supply air to the engine compartment; and a bow hatch attached to the deck and including a wall that faces the air inlet port; wherein the bow hatch includes a second drain port located behind the wall.

5. The boat according to claim 1, wherein the main body is attached to the deck; and a tip of the wall is spaced apart at a distance from the inner surface of the cover.

6. The boat according to claim 5, further comprising:

a drain gap located between the main body and the deck.

7. The boat according to claim 1, further comprising:

a tiltable operator mounted swingably to the deck via a pivot shaft; wherein the deck includes an inclined surface on which the air inlet port is provided; and the inclined surface is oriented so that an angle, defined by the inclined surface and a plane including an axis of the pivot shaft and that extends in a direction in which gravity acts, is equal to or larger than about 20 degrees and equal to or less than about 80 degrees.

8. A boat comprising:

a hull including an engine compartment;

a deck mounted on an upper portion of the hull and including an air inlet port that opens rearward to supply air to the engine compartment; and a bow hatch attached to the deck and including a wall that faces the air inlet port; wherein the air inlet port includes a first air inlet port and a second air inlet port;

a first duct and a second duct extend from the first air inlet port and the second air inlet port, respectively, toward the engine compartment;

the first air inlet port is located on a first side spaced apart from a major axis of the hull in a top view, and the second air inlet port is located on a second side opposite to the first side;

a first end of the first duct is located at the first air inlet port and a second end of the first duct is connected to the engine compartment on the second side; and a first end of the second duct is located at the second air inlet port and a second end of the second duct is connected to the engine compartment on the first side.

9. The boat according to claim 1, wherein the bow hatch includes a first drain port located between the air inlet port and the wall.

10. The boat according to claim 1, wherein the bow hatch includes a second drain port located behind the wall.

11. The boat according to claim 1, wherein the air inlet port includes a first air inlet port and a second air inlet port;

a first duct and a second duct extend from the first air inlet port and the second air inlet port, respectively, toward the engine compartment;

the first air inlet port is located on a first side spaced apart from a major axis of the hull in a top view, and the second air inlet port is located on a second side opposite to the first side;

a first end of the first duct is located at the first air inlet port and a second end of the first duct is connected to the engine compartment on the second side; and a first end of the second duct is located at the second air inlet port and a second end of the second duct is connected to the engine compartment on the first side.

* * * * *